US007868832B2

(12) United States Patent
Krishtul

(10) Patent No.: US 7,868,832 B2
(45) Date of Patent: Jan. 11, 2011

(54) THREE DIMENSIONAL ANTENNAS FORMED USING WET CONDUCTIVE MATERIALS AND METHODS FOR PRODUCTION

(75) Inventor: Izhak Krishtul, Kiryat-Yawm (IL)

(73) Assignee: Galtronics Corporation Ltd., Tiberias (IL)

( * ) Notice: Subject to any disclaimer, the term of this patent is extended or adjusted under 35 U.S.C. 154(b) by 931 days.

(21) Appl. No.: 11/570,420

(22) PCT Filed: Jun. 9, 2005

(86) PCT No.: PCT/IL2005/000611

§ 371 (c)(1),
(2), (4) Date: Apr. 13, 2007

(87) PCT Pub. No.: WO2005/120164

PCT Pub. Date: Dec. 22, 2005

(65) Prior Publication Data

US 2008/0291095 A1 Nov. 27, 2008

Related U.S. Application Data

(60) Provisional application No. 60/676,471, filed on Apr. 28, 2005, provisional application No. 60/631,968, filed on Nov. 29, 2004, provisional application No. 60/579,173, filed on Jun. 10, 2004.

(51) Int. Cl.
*H01Q 1/24* (2006.01)
*H01Q 1/38* (2006.01)

(52) U.S. Cl. ..... 343/702; 343/700 MS; 343/895; 343/873; 29/600

(58) Field of Classification Search ..... None
See application file for complete search history.

(56) References Cited

U.S. PATENT DOCUMENTS

| | | | |
|---|---|---|---|
| 4,100,013 | A | 7/1978 | Medler et al. |
| 4,242,369 | A | 12/1980 | Mansukhani |
| 4,668,533 | A | 5/1987 | Miller |
| 5,204,687 | A | 4/1993 | Elliott et al. |
| 5,943,020 | A | 8/1999 | Liebendoerfer et al. |
| 6,031,505 | A | 2/2000 | Qi et al. |
| 6,037,906 | A | 3/2000 | Engblom et al. |
| 6,115,762 | A | 9/2000 | Bell et al. |
| 6,165,386 | A | 12/2000 | Endo et al. |
| 6,249,261 | B1 | 6/2001 | Solberg, Jr. et al. |
| 6,251,488 | B1 | 6/2001 | Miller et al. |
| 6,259,962 | B1 | 7/2001 | Gothait et al. |
| 6,351,241 | B1 | 2/2002 | Wass et al. |

(Continued)

FOREIGN PATENT DOCUMENTS

| | | |
|---|---|---|
| WO | 2004068389 | 8/2004 |

OTHER PUBLICATIONS

U.S. Appl. No. 60/631,968.

(Continued)

*Primary Examiner*—Trinh V Dinh
(74) *Attorney, Agent, or Firm*—Fish & Richardson P.C.

(57) ABSTRACT

A method for manufacturing antennas including providing a substrate having at least one surface lying in three dimensions and applying a conductive coating to the at least one surface lying in three dimensions, thereby defining an antenna on the at least one surface and an antenna including a conductive coating applied to a three-dimensional surface of a substrate.

10 Claims, 22 Drawing Sheets

U.S. PATENT DOCUMENTS

| | | | | |
|---|---|---|---|---|
| 6,404,393 | B1 | 6/2002 | Nelson et al. | |
| 6,448,935 | B2 | 9/2002 | Fuchs et al. | |
| 6,501,437 | B1 | 12/2002 | Gyorko et al. | |
| 6,575,374 | B1 | 6/2003 | Boyadjian et al. | |
| 6,582,979 | B2 | 6/2003 | Coccioli et al. | |
| 6,636,676 | B1 | 10/2003 | Renn | |
| 6,642,893 | B1 | 11/2003 | Hebron et al. | |
| 6,658,314 | B1 | 12/2003 | Gothait et al. | |
| 6,735,183 | B2 | 5/2004 | O'Toole et al. | |
| 6,765,183 | B1 | 7/2004 | Torres | |
| 6,811,744 | B2 | 11/2004 | Keicher et al. | |
| 6,818,985 | B1 | 11/2004 | Coccioli et al. | |
| 6,823,124 | B1 | 11/2004 | Renn et al. | |
| 2002/0149521 | A1 | 10/2002 | Hendler et al. | |
| 2004/0179808 | A1 | 9/2004 | Renn | |
| 2004/0197493 | A1 | 10/2004 | Renn et al. | |
| 2005/0046664 | A1 | 3/2005 | Renn | |
| 2007/0146226 | A1* | 6/2007 | Oh et al. | 343/873 |
| 2008/0001830 | A1* | 1/2008 | Hirai et al. | 343/702 |
| 2008/0252536 | A1* | 10/2008 | Anguera et al. | 343/702 |

OTHER PUBLICATIONS

U.S. Appl. No. 60/579,173.
U.S. Appl. No. 60/676,471.
R. W. Ziolkowski et al., IEEE Trans. 2003 Antennas Propag., vol. 51, No. 10, pp. 2626-2640.
S. Tretyakov, EPFL Latsis Symposium 2005. Negative Refraction: Revising Electromagnetics from Microwaves to Optics, Lausanne, 28.2-2.03.2005, 3 pages.
N. Engheta, et al., "A Positive Future for Double-Negative Metamaterials", IEEE Trans. on Microwave Theory and Techniques, vol. 53. No. 4, Apr. 2005, pp. 1535-1556.
F. Bilotti, et al., "On EBG Structures for Cellular Phone Applications", Int. J. Electron. Commun. (AEU) 57 (2003) No. 6,403.-408.
B.S. Irwin, et al., "Direct-Wire Processes as Enabling Tools for Novel Antenna Development" Mat. Res. Soc. Symp. Proc. vol. 698, 2002, 5 pages.
R. Colin Johnson, "Matametarial Holds Promise for Antenna, Optics", EETIMEs Online, Apr. 30, 2001, 4 pages.
C. Curtis, et al., "Metallizations by Direct-Write Inkjet Printing", NCPV Program Review Meeting Lakewood, Colorado, Oct. 14-17, 2001, 4 pages.
S. T. Nguyen, et al., "Supramolecular Chemistry: Functional Structures on the Mesoscale", PNAS, Oct. 9, 2001, vol. 98, No. 21, 11849-11850, 7 pages.
Rigney, "Materials and Processes for High Speed Printing for Electronic Components", IS & T's NIP20: 2004 International Conference on Digital Printing Technologies, pp. 275-278.

* cited by examiner

FIG. 6
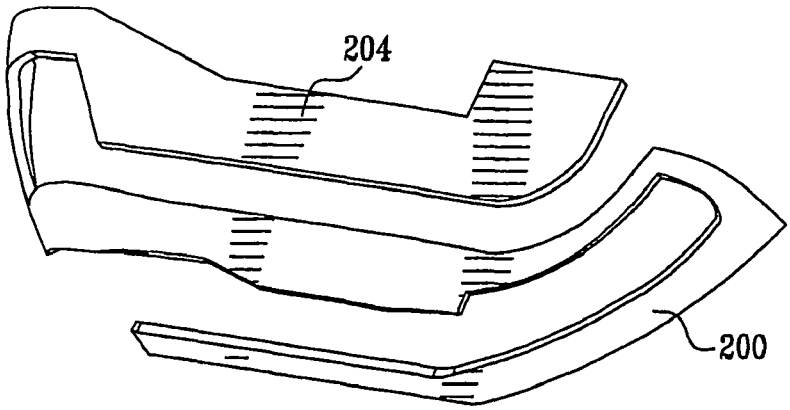
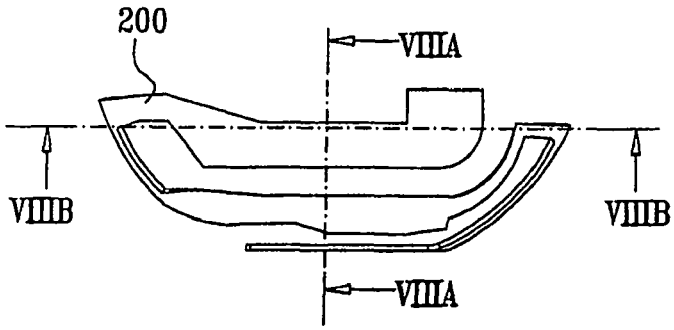
FIG. 7
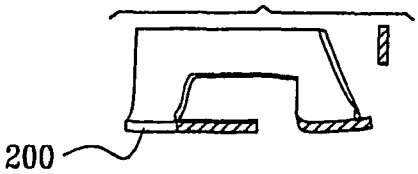
FIG. 8A
FIG. 8B
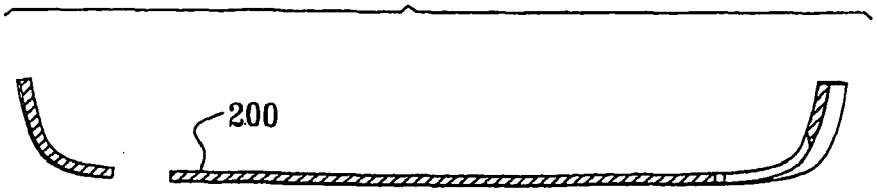

THREE DIMENSIONAL ANTENNAS FORMED USING WET CONDUCTIVE MATERIALS AND METHODS FOR PRODUCTION

REFERENCE TO RELATED APPLICATIONS

Reference is made to U.S. Provisional Patent Application 60/579,173 filed Jun. 10, 2004 entitled "THREE DIMENSIONAL CPA (CONDUCTIVE POLYMER ANTENNA)", to U.S. Provisional Patent Application 60/631,968, filed Nov. 29, 2004 and entitled "THREE DIMENSIONAL CPA (CONDUCTIVE POLYMER ANTENNA)", and to U.S. Provisional Patent Application 60/676,471, filed Apr. 28, 2005 entitled "METHOD FOR APPLYING WET CONDUCTIVE MATERIALS ON A 3D SUBSTRATE", the disclosures of which are hereby incorporated by reference and priority of which is hereby claimed pursuant to 37 CFR 1.78(a) (4) and (5)(i)

FIELD OF THE INVENTION

The present invention relates to antennas generally and to methods of manufacture thereof.

BACKGROUND OF THE INVENTION

The following patents and published patent applications are believed to represent the current state of the art:

U.S. Pat. Nos. 6,404,393; 6,115,762; 6,031,505; 4,100,013; 4,242,369; 4,668,533; 6,658,314; 6,259,962; 6,582,979; 6,765,183; 6,249,261; 6,501,437; 6,575,374; 6,735,183; 6,818,985; 6,251,488; 6,636,676; 6,811,744; 6,823,124; 6,642,893; 6,037,906; 6,351,241; 5,204,687 and 5,943,020.

Published PCT Patent Application WO2004/068389.

Published U.S. Patent Applications 2004/0197493; 2004/0179808 and 2005/0046664.

SUMMARY OF THF INVENTION

The present invention seeks to provide an improved antenna and methods for manufacturing thereof.

There is thus provided in accordance with a preferred embodiment of the present invention a method for manufacturing antennas including providing a substrate having at least one surface lying in three dimensions and applying a conductive coating to the at least one surface lying in three dimensions, thereby defining an antenna on the at least one surface.

There is also provided in accordance with another preferred embodiment of the present invention a method for manufacturing mobile communicators including providing a substrate having at least one surface lying in three dimensions, the substrate defining at least one of a housing portion and a carrier element of a mobile communicator, and applying a conductive coating to the at least one surface lying in three dimensions, thereby defining an antenna on the at least one surface.

Preferably, the applying a conductive coating includes applying the conductive coating in a predetermined pattern, which corresponds to the configuration of the antenna. Additionally or alternatively, the applying a conductive coating includes applying a conductive polymer coating. Additionally, the applying a conductive polymer coating includes applying at least one of silver and nanoparticles.

Preferably, the applying a conductive coating includes spraying the conductive coating onto a pre-masked substrate. Additionally or alternatively, the applying a conductive coating includes spraying the conductive coating onto the substrate and thereafter patterning the conductive coating. Alternatively or additionally, the applying a conductive coating includes microdispensing the conductive coating onto the surface. Additionally or alternatively, the applying a conductive coating includes dipping the surface in a conductive coating bath and thereafter patterning the conductive coating.

Preferably, the applying a conductive coating includes at least one of chemical vapor deposition, physical vapor deposition and electroless plating of a pre-patterned three-dimensional substrate. Alternatively or additionally, the applying a conductive coating includes pad printing at least one of interior portions and non-highly angled portions of the three-dimensional substrate and applying sub-micron conductive particles to at least one of peripheral portions and highly angled portions of the three-dimensional substrate.

Preferably, the antenna is an embedded antenna.

There is further provided in accordance with yet another preferred embodiment of the present invention a method for manufacturing a precision three-dimensional conductive layer including providing a substrate having at least one surface having at least a first generally two-dimensional surface portion and at least a second generally three-dimensional surface portion, applying a conductive coating to at least a first generally two-dimensional surface portion and applying sub-micron conductive particles to at least a second generally three-dimensional surface portion, wherein the conductive coating on at least a first generally two-dimensional surface portion and the sub-micron conductive particles on at least a second generally three-dimensional surface portion together define the precision three-dimensional conductive layer.

Preferably, the applying sub-micron conductive particles includes applying the sub-micron conductive particles in a predetermined pattern, the outer extent of which corresponds to the configuration of the precision three-dimensional conductive layer. Additionally or alternatively, the applying a conductive coating includes applying a conductive polymer coating. Additionally, the applying a conductive polymer coating includes applying at least one of silver and nanoparticles.

Preferably, the applying a conductive coating utilizes pad printing. Additionally, the precision three-dimensional conductive layer is formed on a plastic support element, which forms part of a mobile communicator.

There is yet further provided in accordance with still another preferred embodiment of the present invention an antenna including a conductive coating applied as a wet conductive material to at least one three-dimensional surface.

There is also provided in accordance with yet another preferred embodiment of the present invention an antenna including a conductive coating applied to a three-dimensional surface of a substrate.

Preferably, the conductive coating is a polymer. More preferably, the polymer includes at least one of silver and nanoparticles.

There is additionally provided in accordance with another preferred embodiment of the present invention a mobile communicator including a housing portion, a carrier element, at least one of the housing portion and the carrier element defining a substrate having at least one surface lying in three dimensions, and an antenna, the antenna defined by a conductive coating applied to the at least one surface lying in three dimensions.

Preferably, the conductive coating includes a predetermined pattern, which corresponds to the configuration of the antenna. Additionally, the antenna is embedded in at least one of the housing portion and the carrier element.

Preferably, the conductive coating is a polymer. More preferably, the polymer includes at least one of silver and nanoparticles.

There is yet further provided in accordance with another preferred embodiment of the present invention, a precision three-dimensional conductive layer, the conductive layer being applied to at least one support surface having at least a first generally two-dimensional surface portion and at least a second generally three-dimensional surface portion, the conductive layer including a conductive coating applied to at least a first generally two-dimensional surface portion and sub-micron conductive particles applied to at least a second generally three-dimensional surface portion.

Preferably, the sub-micron conductive particles are applied in a predetermined pattern extending at least generally along the periphery of the precision three-dimensional conductive layer. Additionally or alternatively, the conductive coating is a polymer. Preferably, the polymer includes at least one of silver and nanoparticles.

BRIEF DESCRIPTION OF THE DRAWINGS

The present invention will be understood and appreciated more fully from the following detailed description, taken in conjunction with the drawings in which:

FIG. 6 is a simplified pictorial illustration of the embedded antenna of FIG. 5;

FIG. 7 is a simplified plan view illustration of the embedded antenna of FIGS. 5 & 6;

FIGS. 8A and 8B are simplified sectional illustrations of the embedded antenna of FIGS. 5-7, taken along lines VIIIA-VIIIA and VIIIB-VIIIM in FIG. 7;

DETAILED DESCRIPTION OF PREFERRED EMBODIMENTS

Figure 1:
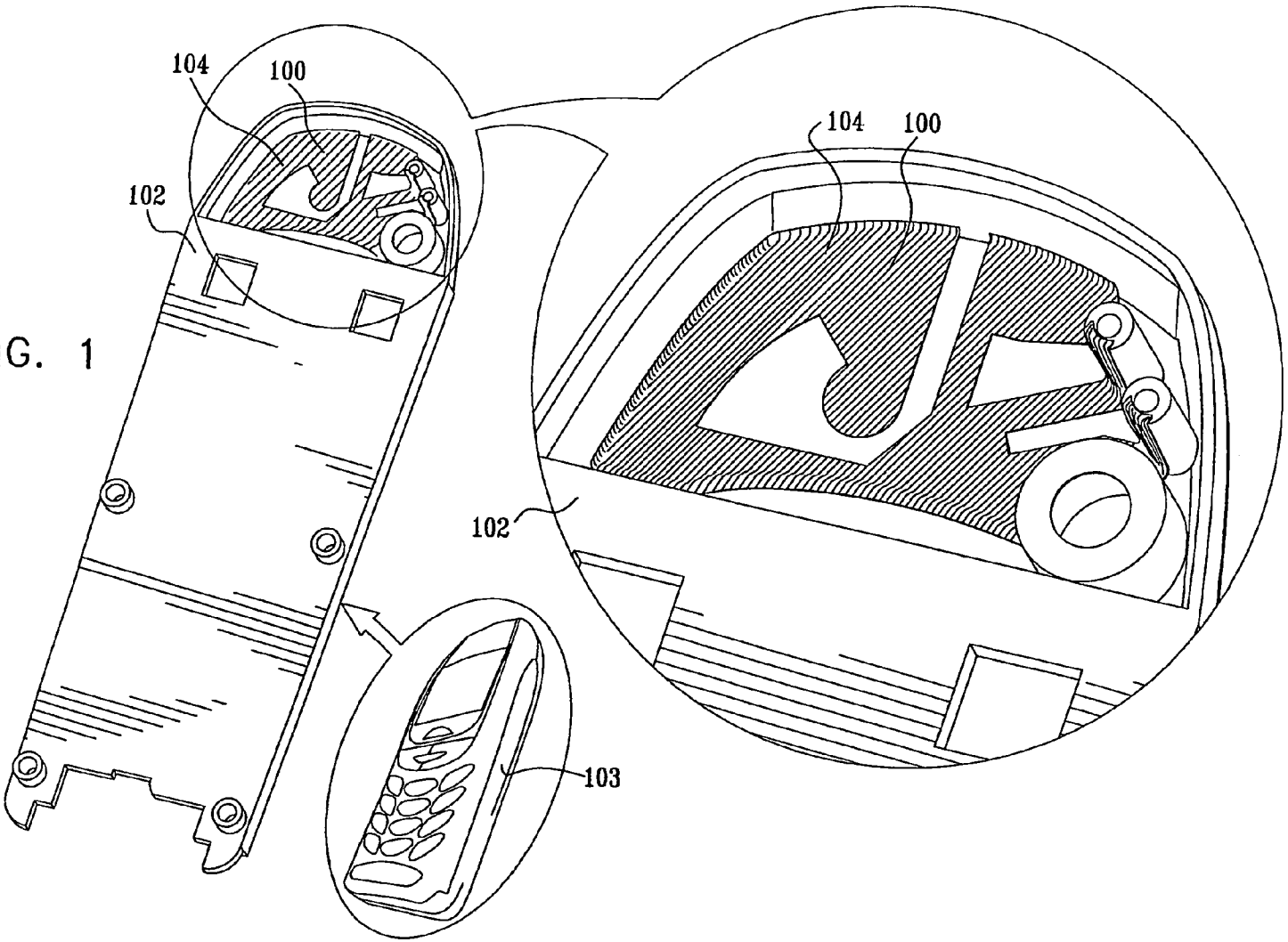
FIG. 1 is a simplified pictorial illustration of an embedded antenna formed by a wet conductive coating on a three-dimensional substrate, forming part of a mobile communicator, constructed and operative in accordance with a preferred embodiment of the present invention.
Figure 2:
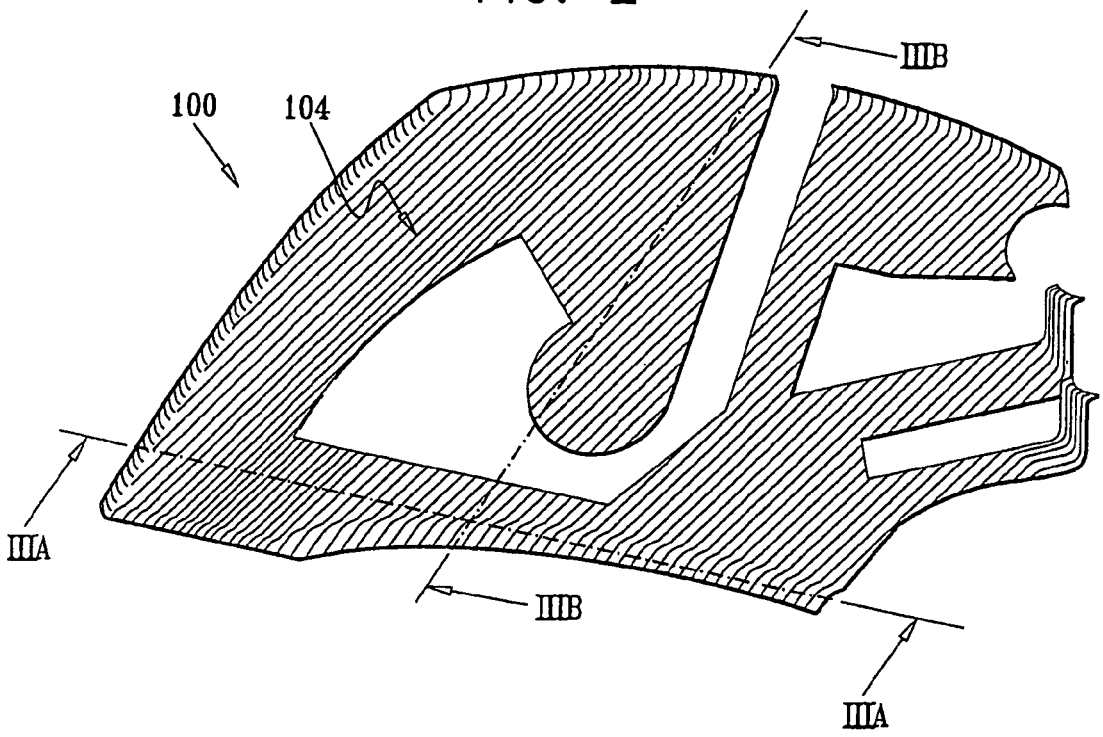
FIG. 2 is a simplified pictorial illustration of the embedded antenna of FIG. 1.
Figure 3A:
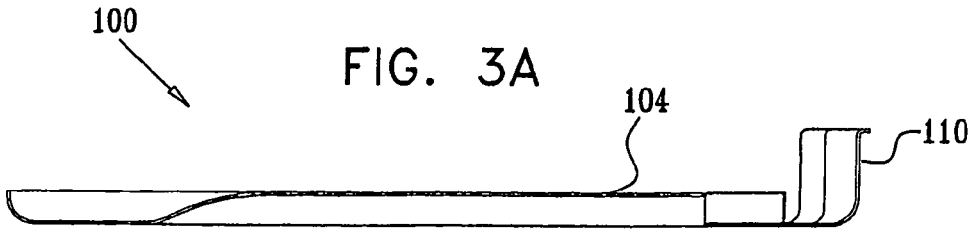
FIGS. 3A and 3B are simplified sectional illustrations of the embedded antenna of FIGS. 1 & 2, taken along lines IIIA-IIIA and IIIB-IIIB in FIG. 2.
Figure 3B:
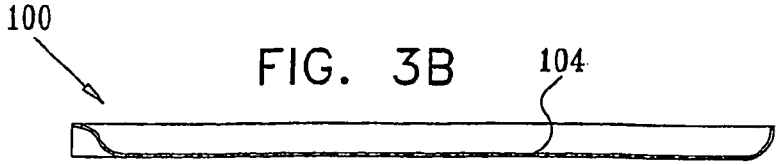

Reference is now made to FIG. 1, which is a simplified pictorial illustration of an embedded antenna, constructed and operative in accordance with a preferred embodiment of the present invention, formed by a conductive coating on a three-dimensional substrate, forming part of a mobile communicator; FIG. 2, which is a simplified pictorial illustration of the embedded antenna of FIG. 1, showing an antenna pattern created by applying a wet conductive polymer to the substrate and FIGS. 3A and 3B which are simplified sectional illustrations of the embedded antenna of FIGS. 1 & 2, taken along lines IIIA-IIIA and IIIB-IIIB in FIG. 2.

As seen in FIGS. 1-3B, an embedded antenna 100 is formed by coating a three-dimensional substrate, such as part of the back casing 102 of a mobile telephone 103, with a wet conductive coating 104. The conductive coating 104 preferably comprises silver. Alternatively, the conductive coating may employ any other suitable conductor. Generally, wet conductive materials useful in the present invention preferably comprise conductive polymers, but may also include conductive ink jet inks, pigmented inks, conductive nanopastes, hybrid nanopastes, conductive nanoparticles, microparticles and nanometal powders. Other suitable materials may include Electronic Band-Gap (EBG) structures and Frequency Selective Surface (FSS) materials or other suitable types of metamaterials, such as those described in Research on negative refraction and backward-wave media: A historical perspective by Sergei Tretyakov, EPFL Latsis Symposium 2005; Negative refraction: revisiting electromagnetics from microwaves to optics, Lausanne 28.2-2.03.2005, pp 30-35; On EBG Structures for Cellular Phone Applications, by Filiberto Bilotti et al AEU International Journal of Electronics and Communications 57 (2003) No. 6, 403-408; A Positive Future for Double-Negative Metamaterials, by Nader Engheta et al, IEEE Transactions on Microwave Theory and Techniques, Vol. 53, NO. 4, pp. 1535-1556, April 2005; Application of double negative metamaterials to increase the power radiated by electrically small antennas, by R. W. Aiolkowski et al, IEEE Trans. Antennas Propag., Vol. 51, NO. 10, pp. 2626-2640, October 2003. The disclosures of these publications are hereby incorporated by reference.

Figure 4A:
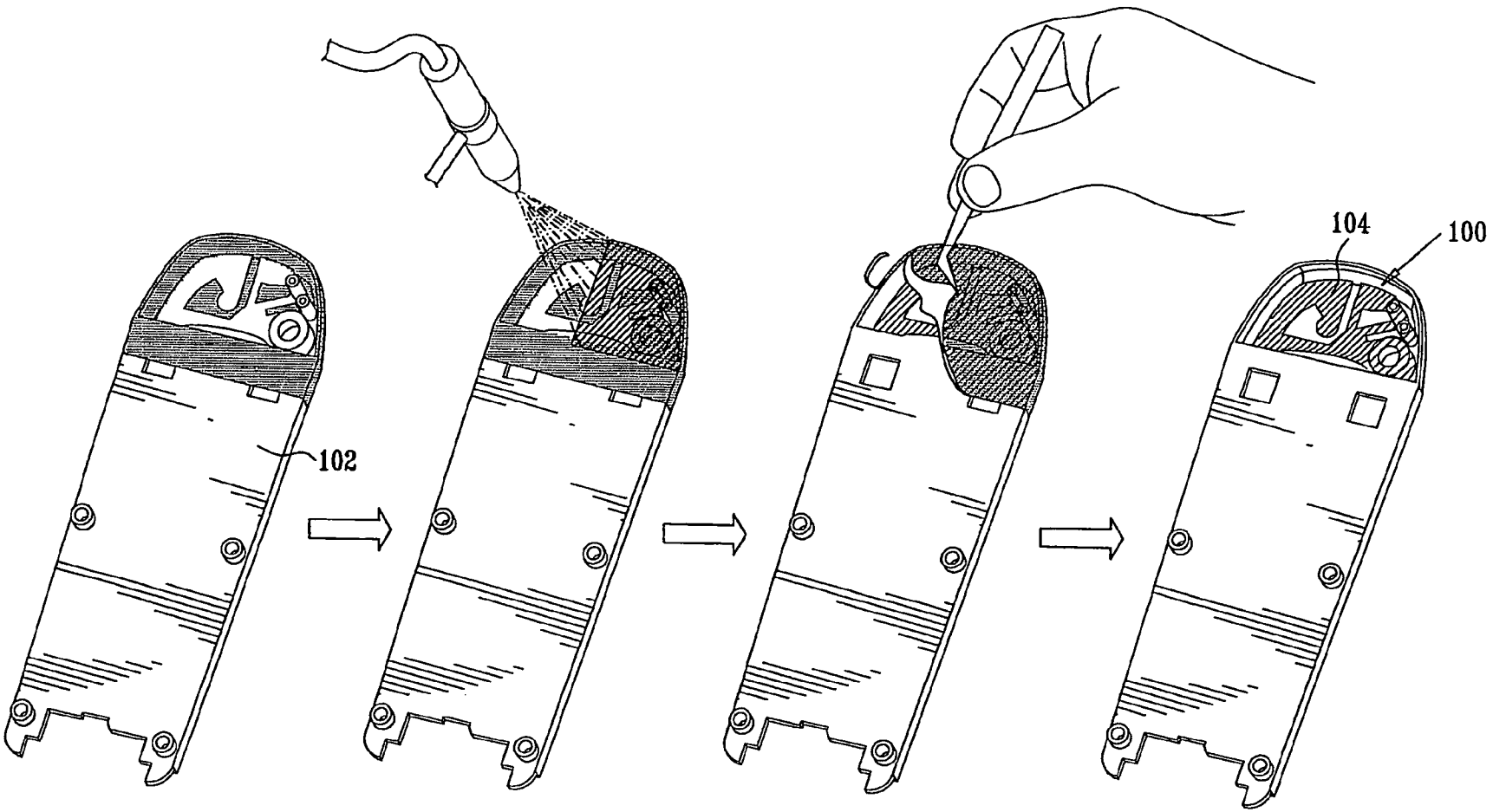
FIGS. 4A, 4B, 4C, 4D, 4E and 4F are simplified illustrations of six alternative methodologies for producing the embedded antenna of FIGS. 1-3B.
Figure 4B:
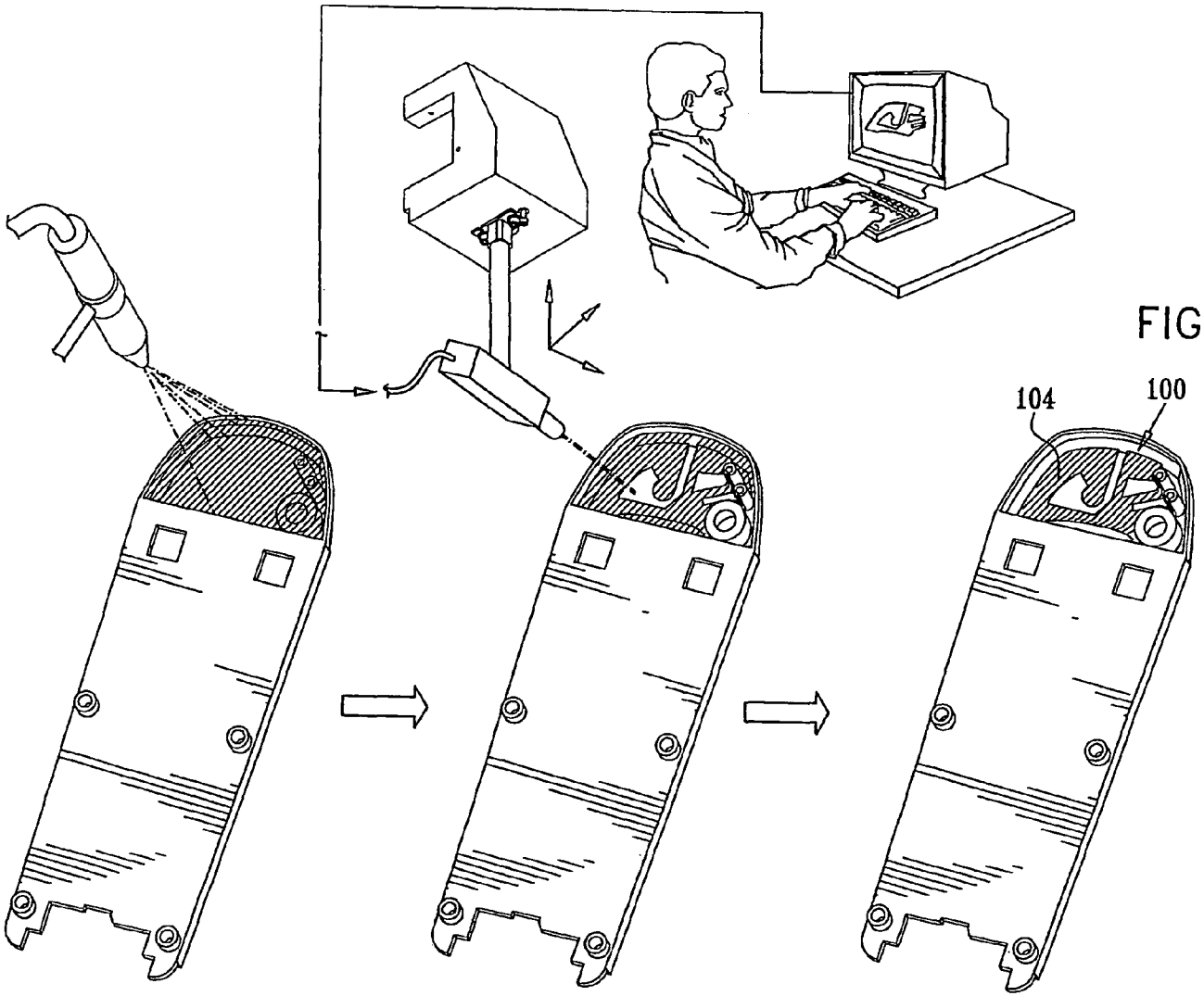
Figure 4C:
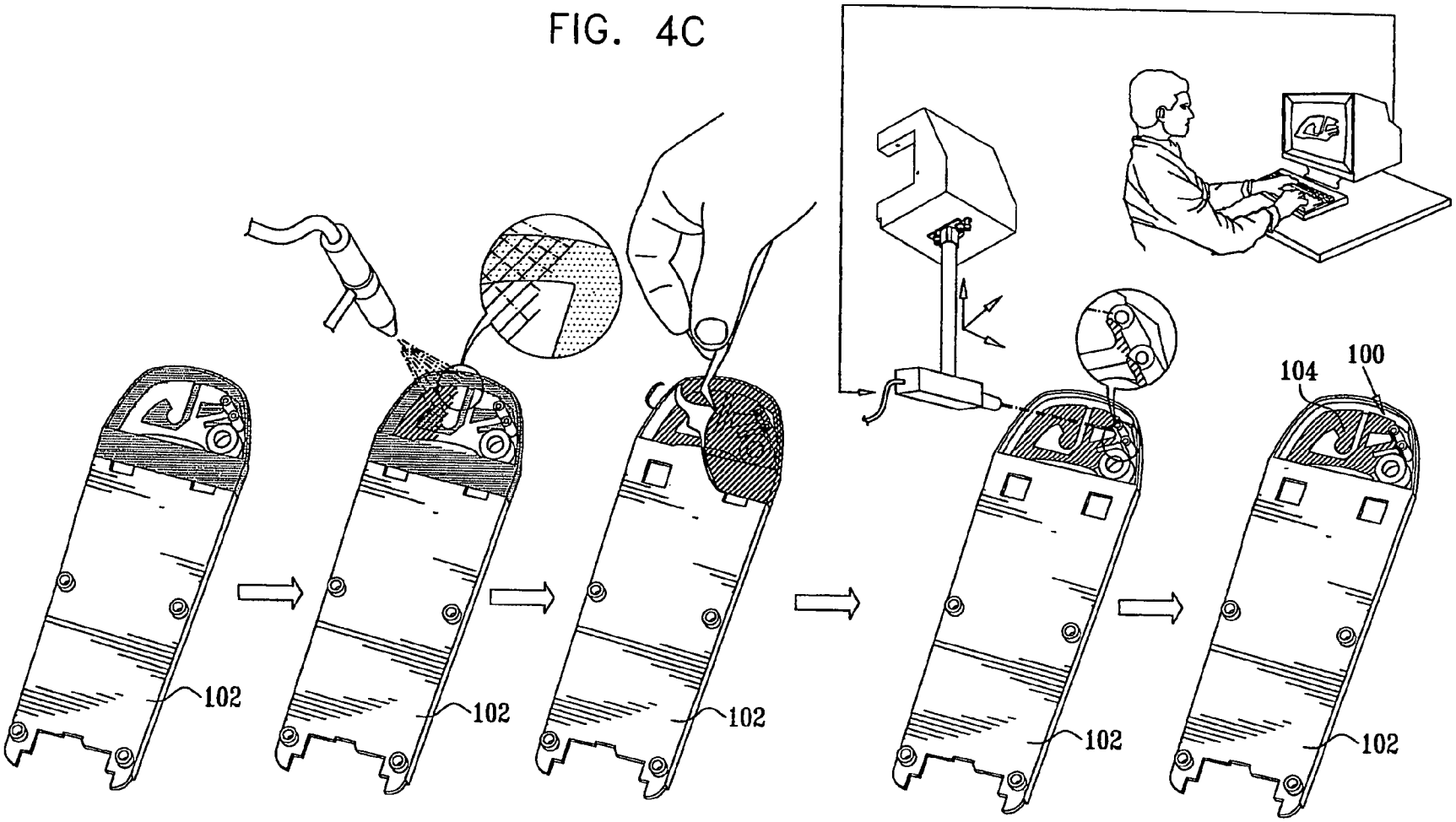
Figure 4D:
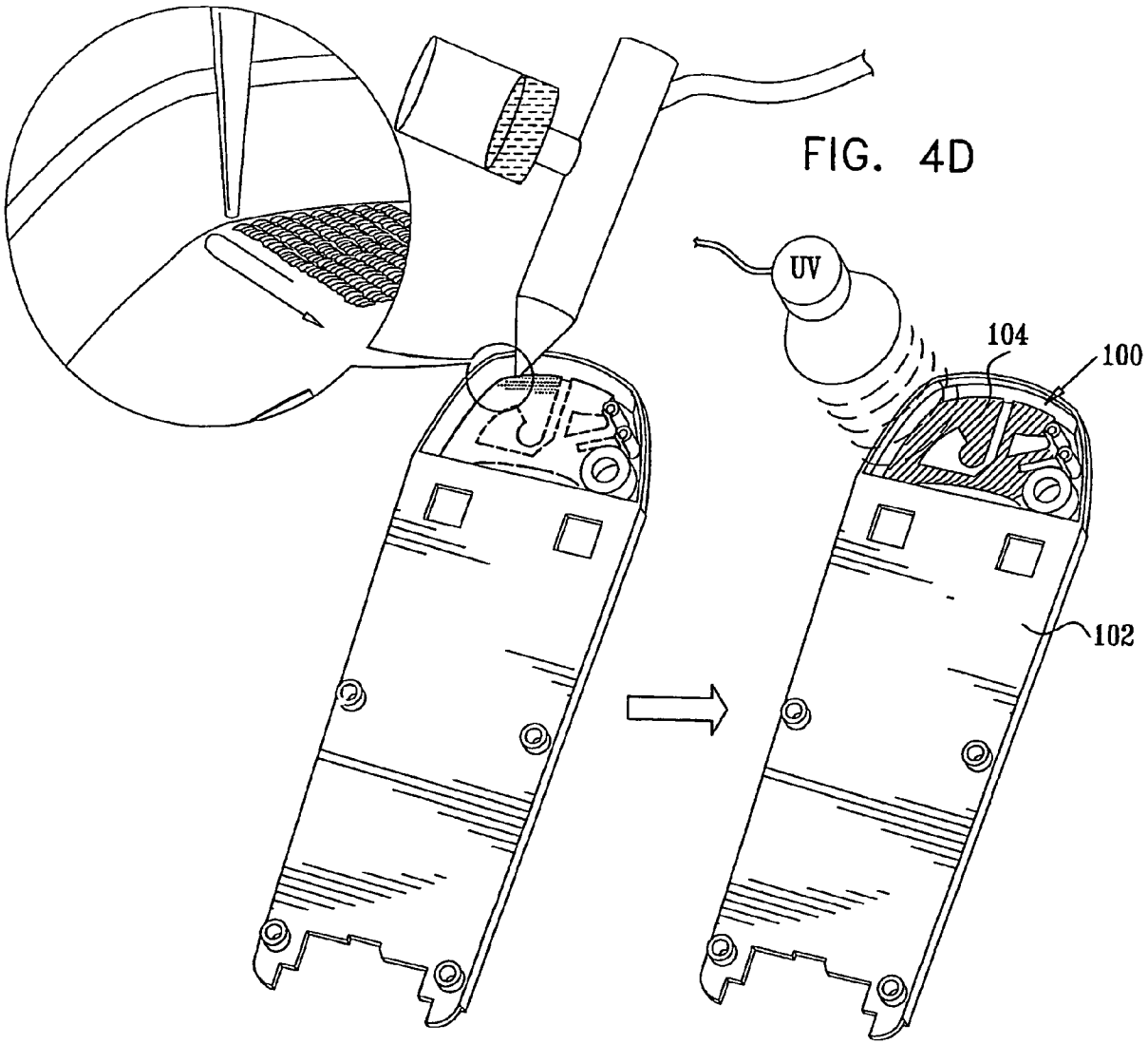
Figure 4E:
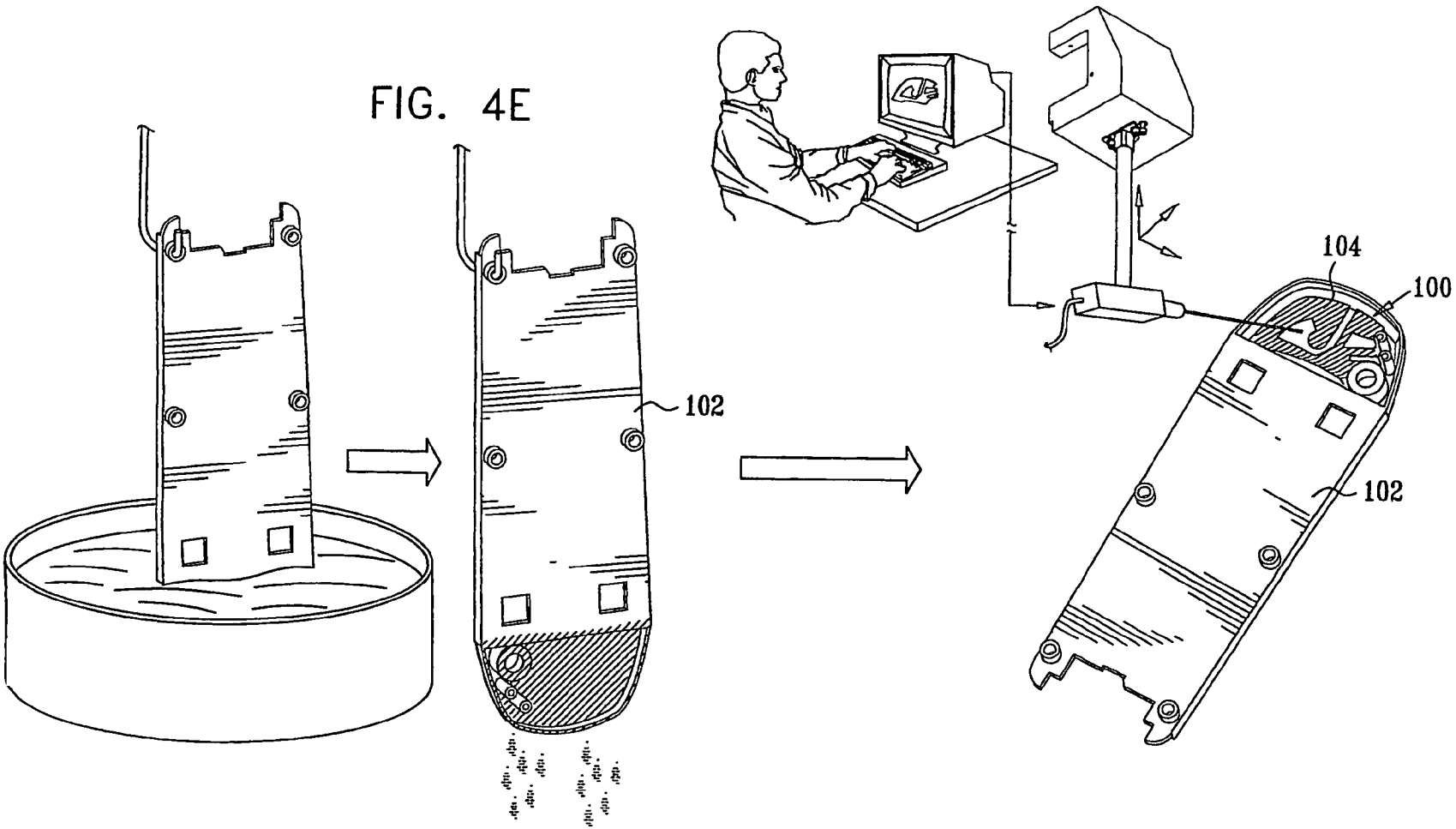

The wet conductive coating may be applied to the three-dimensional substrate by any suitable technique. Examples of suitable techniques include spraying the conductive coating onto a pre-masked substrate as seen in FIG. 4A; spraying the conductive coating onto a substrate and thereafter patterning the coating on the substrate as seen in FIG. 4B; a combination of the foregoing two examples as seen in FIG. 4C; microdispensing as seen in FIG. 4D, preferably employing equipment and techniques commercially available from Dick Blick Art Materials P.O. Box 1267, Galesburg, IL USA, and dipping and subsequent laser patterning as seen in FIG. 4E.

Other examples of suitable coating techniques include: chemical vapor deposition, physical vapor deposition and electroless plating of a pre-patterned three-dimensional substrate.

Figure 4F:
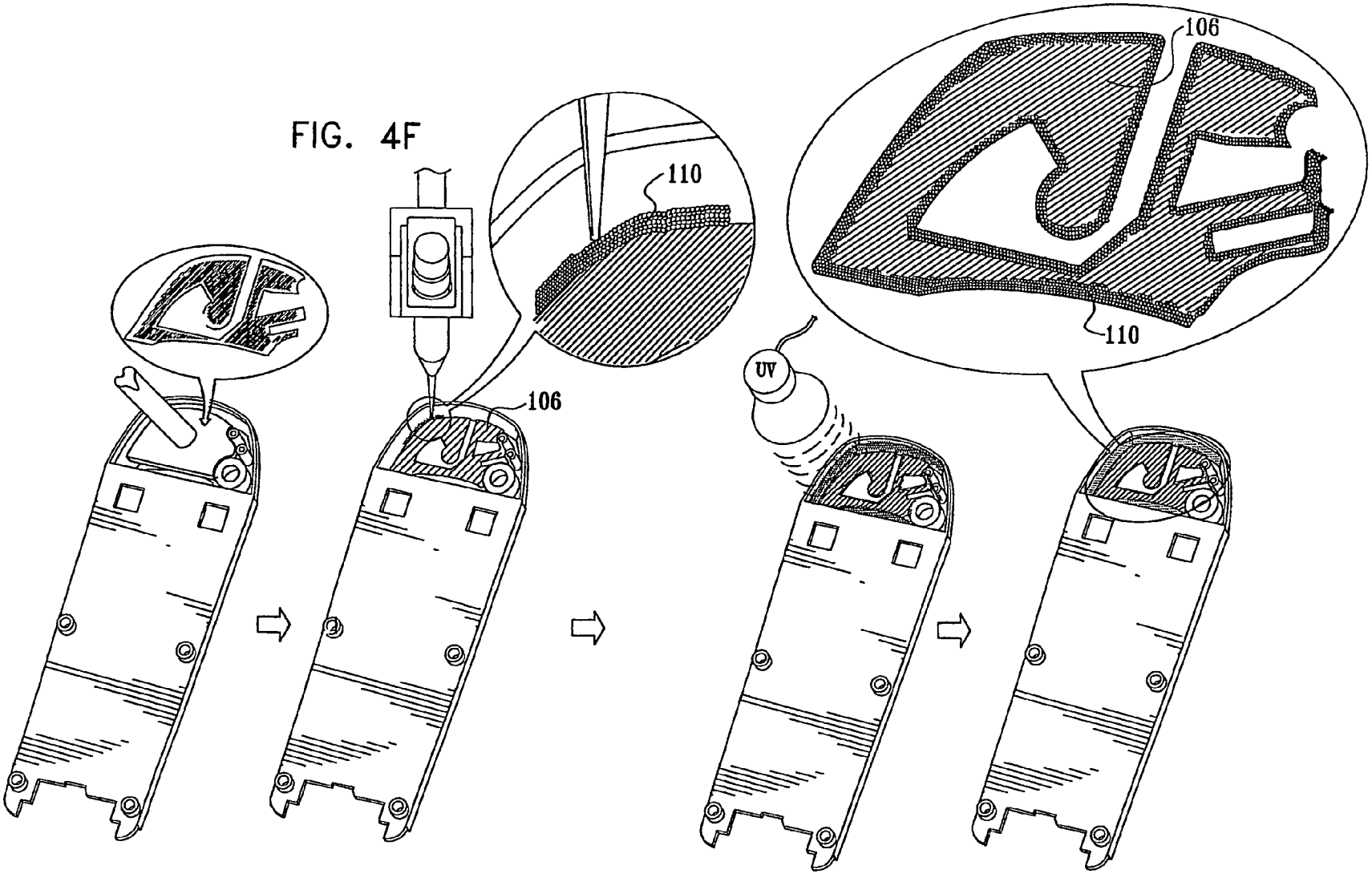

Another preferred technique, illustrated in FIG. 4F, is a combination of pad printing of interior and non-highly angled portions, such as portions designated by reference numeral 106, of the three-dimensional substrate and applying submicron conductive particles to the peripheral and highly angled portions of the three-dimensional substrate, such as portions designated by reference numeral 110. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference.

Additional techniques which may be employed with suitable adaptations in forming the antennas of FIGS. 1-3B are described in Published PCT Patent Application WO 2004/068389 A2, a document entitled Metallizations by Direct-Write Inkjet Printing, NREL/CP-520-31020, published by the National Renewable Energy Laboratory, and a document entitled Materials and Processes for High Speed Printing for Electronic Components, IS & T NIP20: 2004 International Conference on Digital Printing Technologies, pages 275-278, the contents of which are hereby incorporated by reference, and in references mentioned therein, the contents of which are hereby incorporated by reference.

Figure 5:
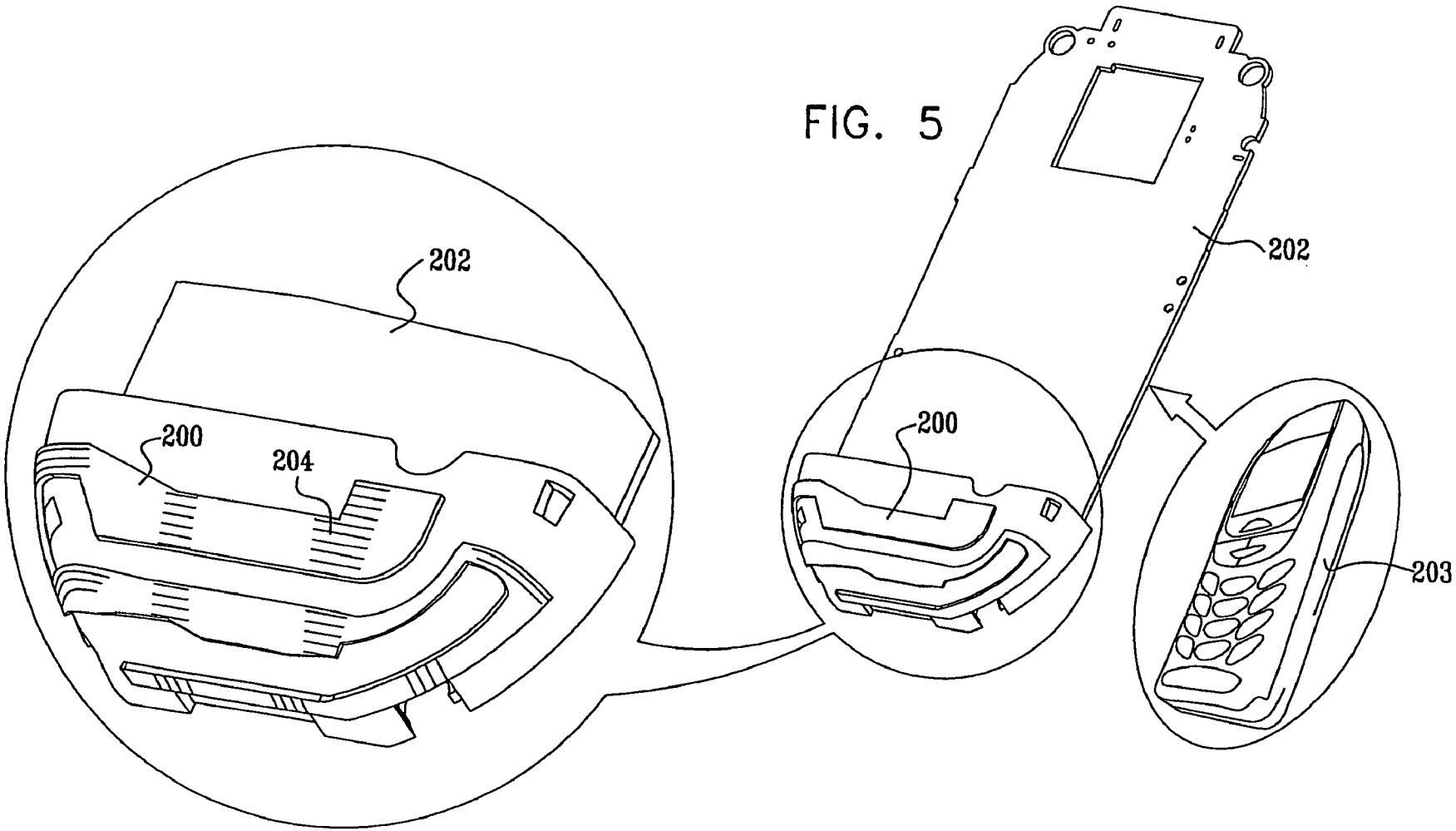
FIG. 5 is a simplified pictorial illustration of an embedded antenna formed by a conductive coating on a three-dimensional plastic support element, forming part of a mobile communicator, constructed and operative in accordance with a preferred embodiment of the present invention.

Reference is now made to FIG. 5, which is a simplified pictorial illustration of an embedded antenna formed in accordance with a preferred embodiment of the present invention by applying a wet conductive coating to a three-dimensional plastic element support, forming part of a mobile communicator; FIG. 6 which is a simplified pictorial illustration of the embedded antenna of FIG. 5, showing an antenna pattern created by applying the conductive polymer to the element support; FIG. 7 which is a simplified plan view illustration of the embedded antenna of FIGS. 5 & 6 and FIGS. 8A and 8B which are simplified sectional illustrations of the embedded antenna of FIGS. 5-7, taken along lines VIIIA-VIIIA and VIIIB-VIIIB in FIG. 7.

As seen in FIGS. 5-8B, an embedded antenna 200 is formed by coating a three-dimensional substrate, such as part of the plastic element carrier 202 of a mobile telephone 203, with a conductive coating 204. The conductive coating preferably comprises silver. Alternatively, the conductive coating may employ any other suitable conductor. Generally, conductive materials useful in the present invention preferably comprise conductive polymers but may also include conductive ink jet inks, pigmented inks, conductive nanopastes, hybrid nanopastes, conductive nanoparticles, microparticles and nanometal powders. Other suitable materials may include Electronic Band-Gap (EBG) structures and Frequency Selective Surface (FSS) materials or other suitable types of metamaterials, such as those described in Research on negative refraction and backward-wave media: A historical perspective by Sergei Tretyakov, EPFL Latsis Symposium 2005; Negative refraction: revisiting electromagnetics from microwaves to optics, Lausanne 28.2-2.03.2005, pp 30-35; On EBG Structures for Cellural Phone Applications, by Filiberto Bilotti et al AEU International Journal of Electronics and Communications 57 (2003) No. 6, 403-408; A Positive Future for Double-Negative Metamaterials, by Nader Engheta et al, IEEE Transactions on Microwave Theory and Techniques, Vol. 53, NO. 4, pp. 1535-1556, April 2005; Application of double negative metamaterials to increase the power radiated by electrically small antennas, by R. W. Aiolkowski et al, IEEE Trans. Antennas Propag., Vol. 51, NO. 10, pp. 2626-2640, October 2003. The disclosures of these publications are hereby incorporated by reference.

Figure 9A:
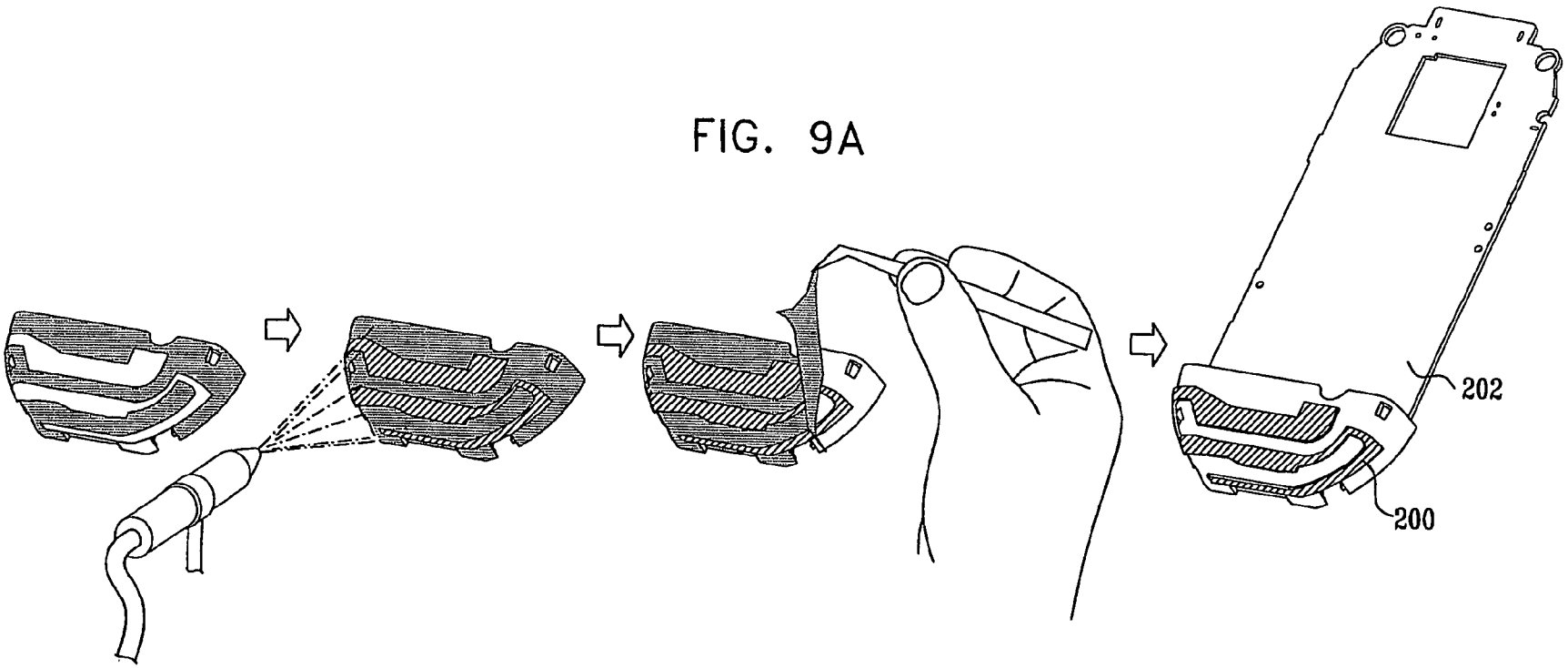
FIGS. 9A, 9B, 9C, 9D, 9E and 9F are simplified illustrations of six alternative methodologies for producing the embedded antenna of FIGS. 5-8B.
Figure 9B:
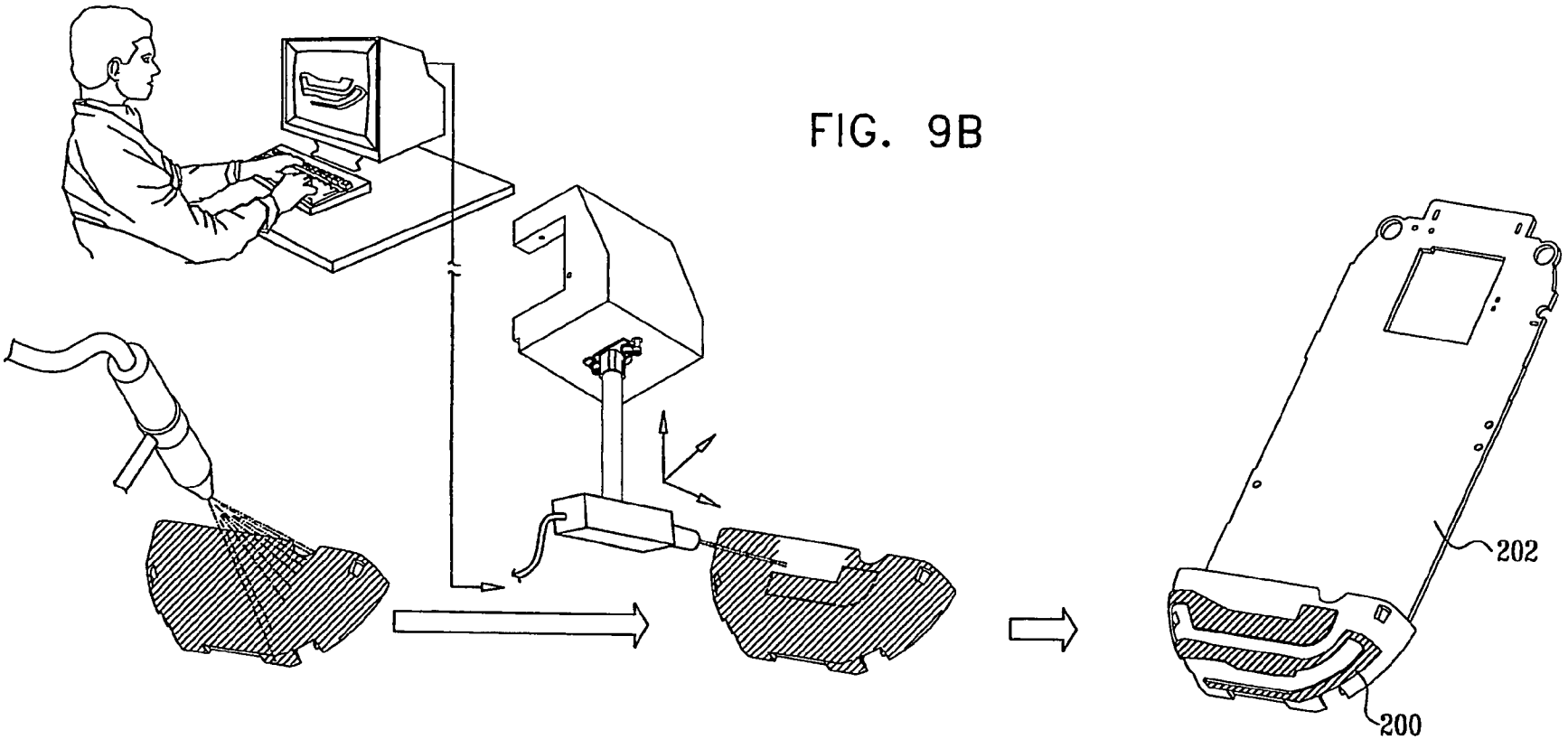
Figure 9C:
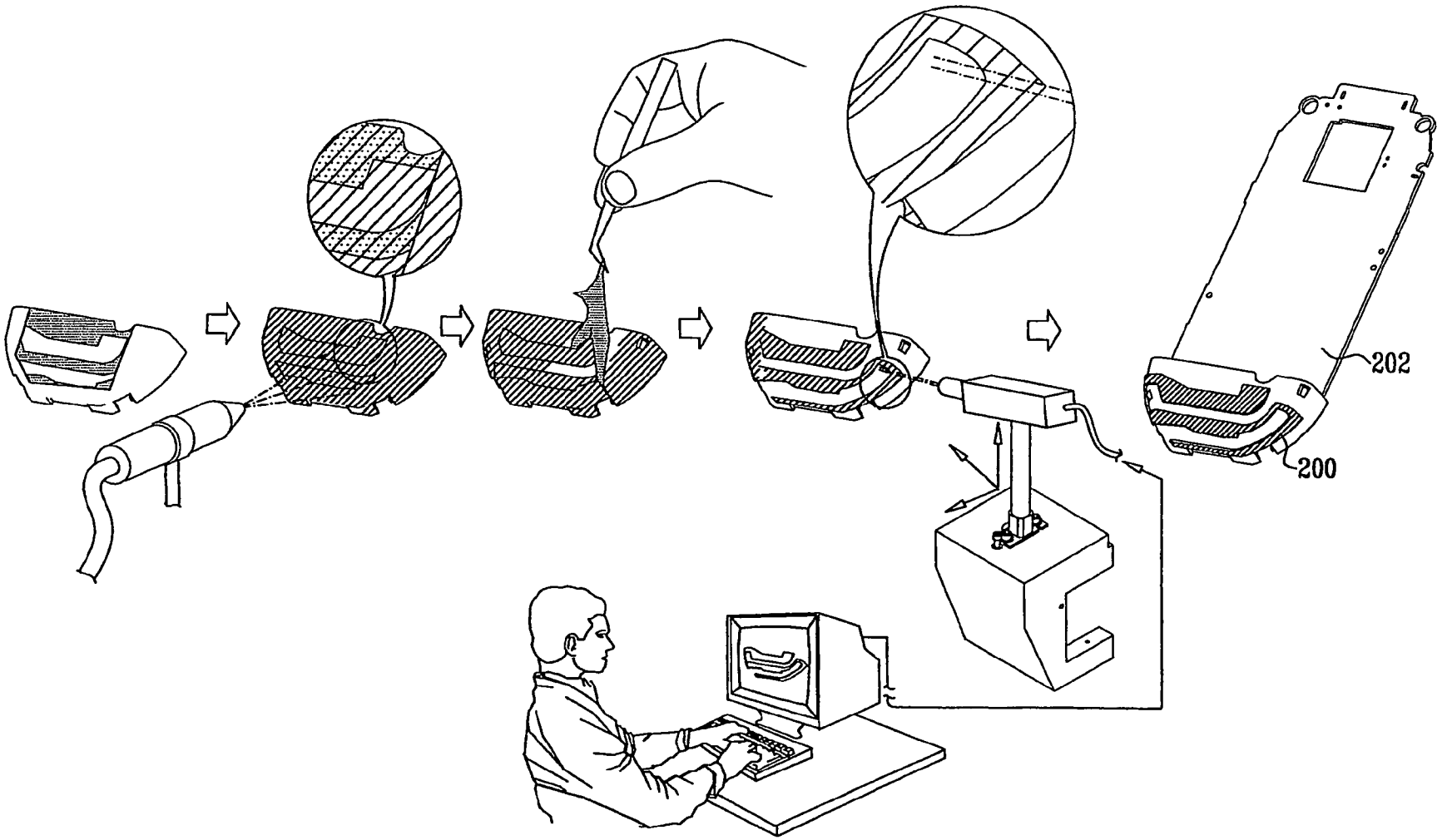
Figure 9D:
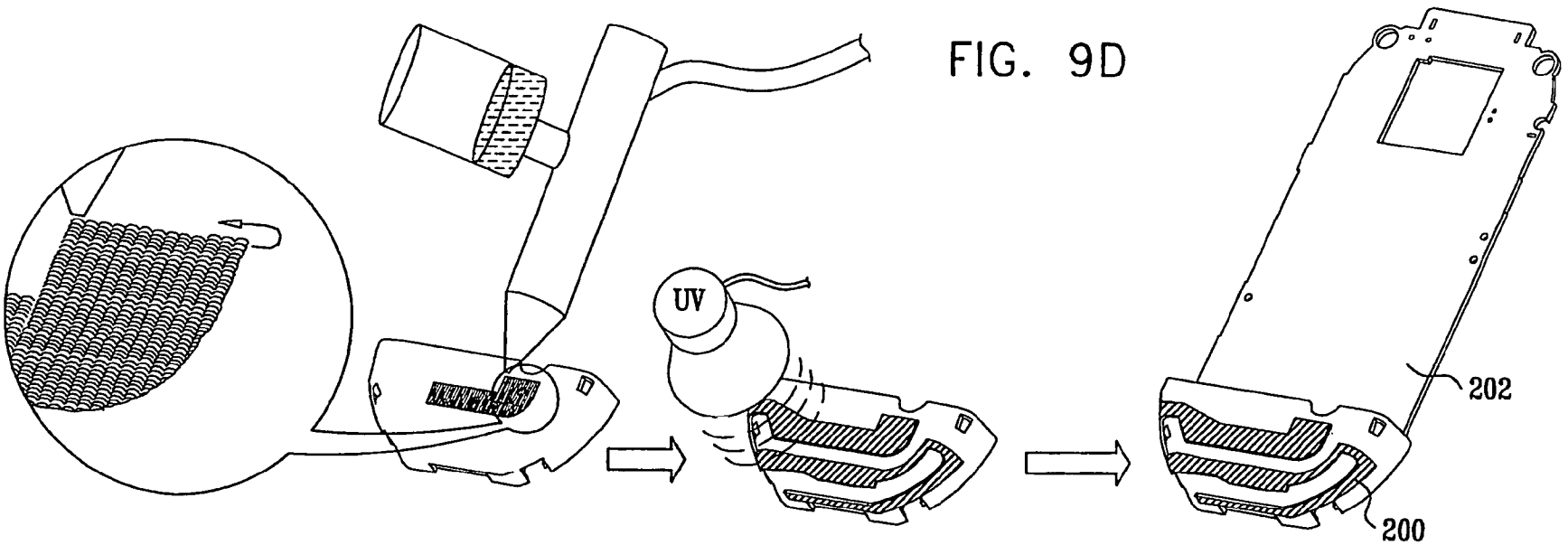
Figure 9E:
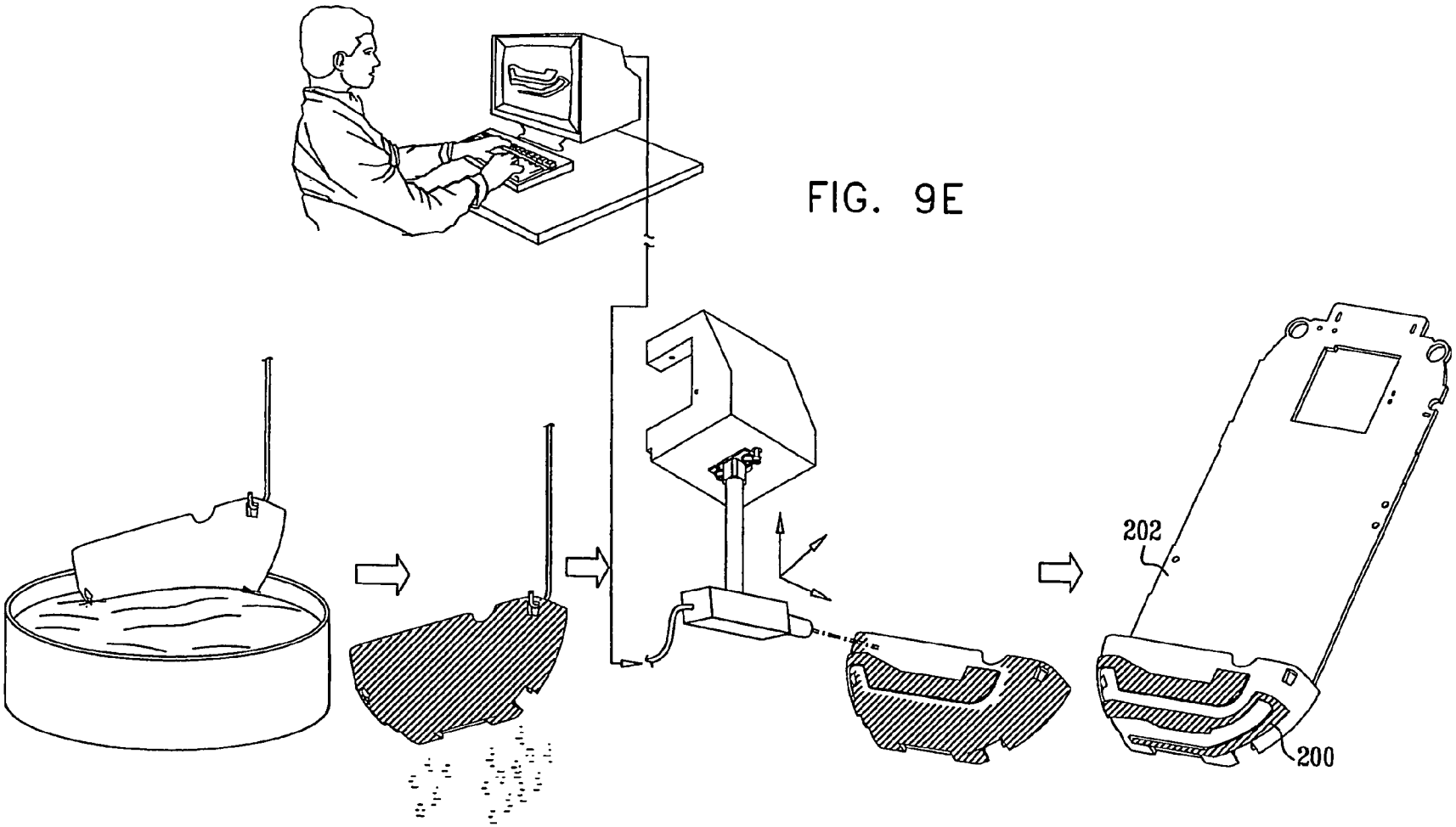

The conductive coating may be applied to the three-dimensional substrate by any suitable technique. Examples of suitable techniques include spraying the conductive coating onto a pre-masked substrate as seen in FIG. 9A; spraying the conductive coating onto a substrate and thereafter patterning the coating on the substrate and seen in FIG. 9B; a combination of the foregoing two examples as seen in FIG. 9C; microdispensing as seen in FIG. 9D; dipping and subsequent laser patterning as seen in FIG. 9E.

Other examples of suitable coating techniques include: chemical vapor deposition; physical vapor deposition and electroless plating of a pre-patterned three-dimensional substrate.

Figure 9F:
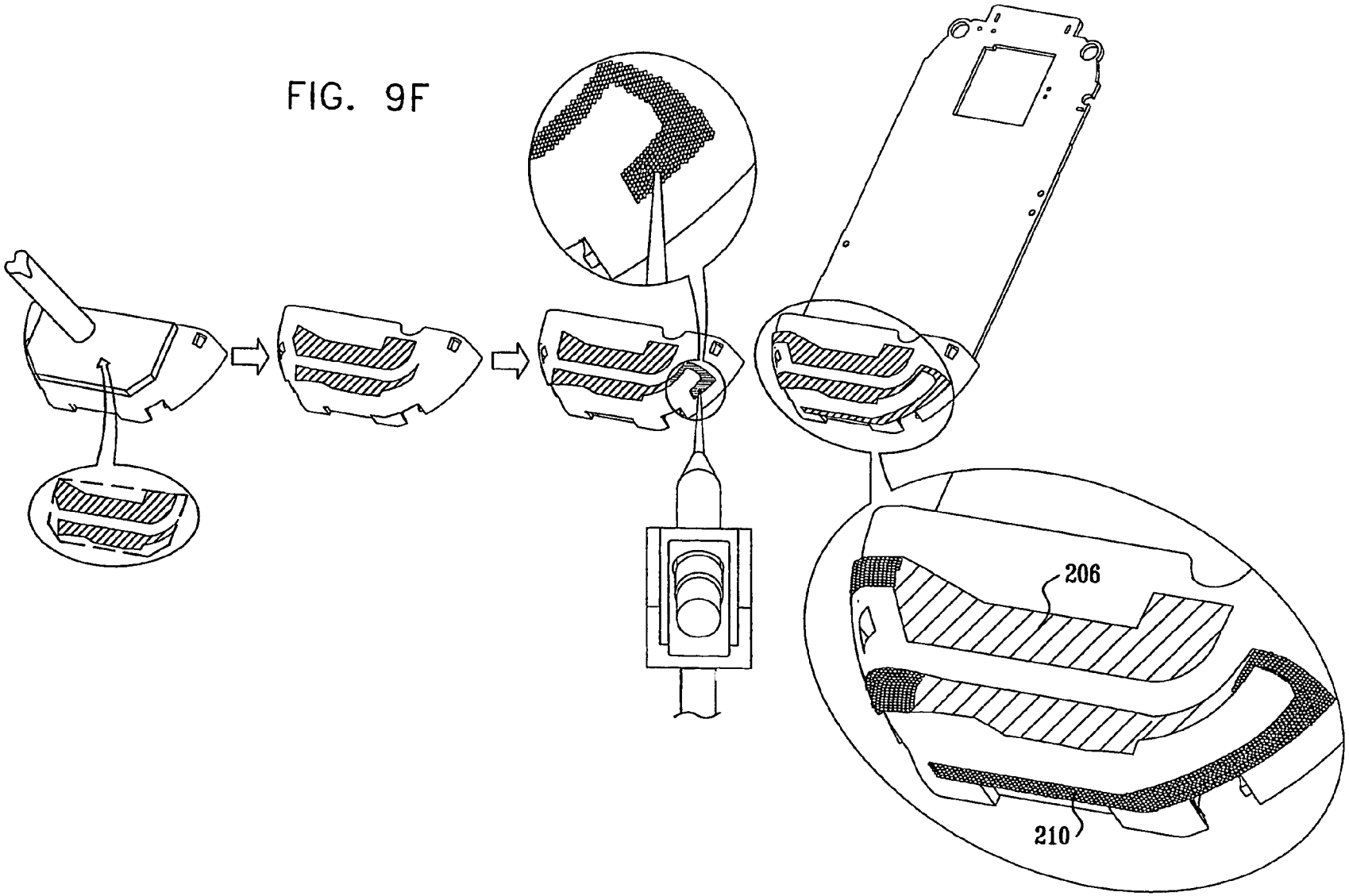

Another preferred technique, illustrated in FIG. 9F, is a combination of pad printing of interior and non-highly angled portions, such as portions designated by reference numeral 206 of the three-dimensional substrate and applying submicron conductive particles to the peripheral and highly angled portions of the three-dimensional substrate, such as portions designated by reference numeral 210. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference.

Additional techniques which may be employed with suitable adaptations in forming the antennas of FIGS. 5-7B are described in Published PCT Patent Application WO 2004/068389 A2, a document entitled Metallizations by Direct-Write Inkjet Printing, NREL/CP-520-31020, published by the National Renewable Energy Laboratory, and a document entitled Materials and Processes for High Speed Printing for Electronic Components, IS & T NIP20: 2004 International Conference on Digital Printing Technologies, pages 275-278, the contents of which are hereby incorporated by reference, and in references mentioned therein, the contents of which are hereby incorporated by reference.

Figure 10A:
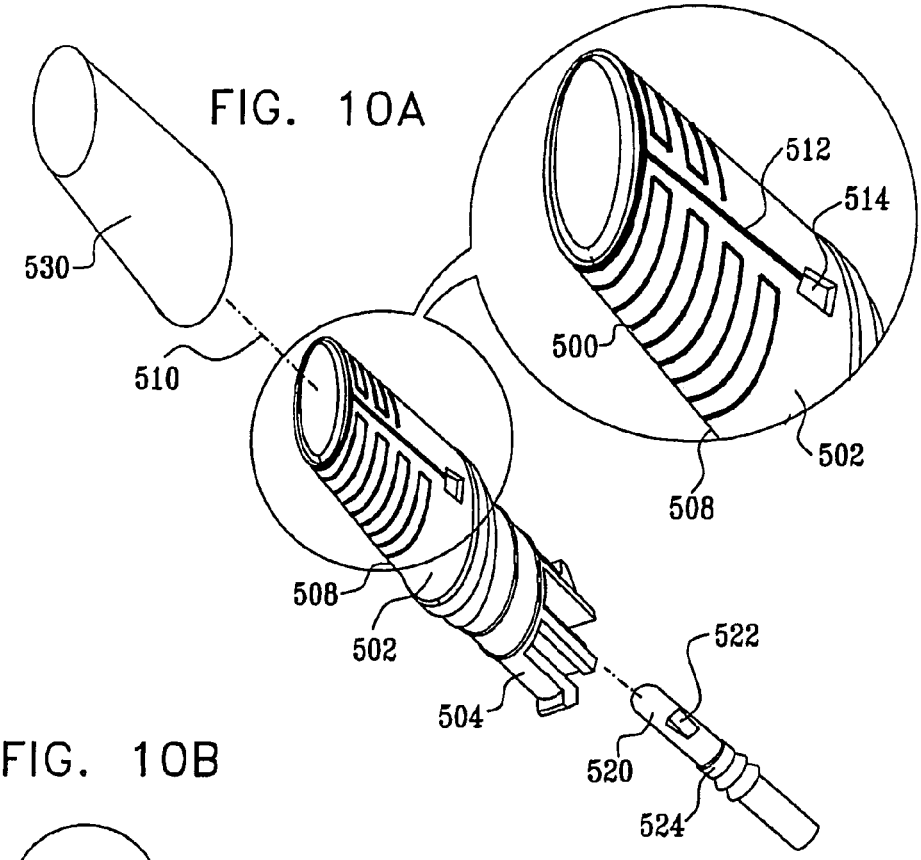
FIG. 10A is a simplified pictorial exploded view illustration of an external snap-in antenna including a three-dimensional meander radiating element, constructed in accordance with a preferred embodiment of the present invention.
Figure 10B:
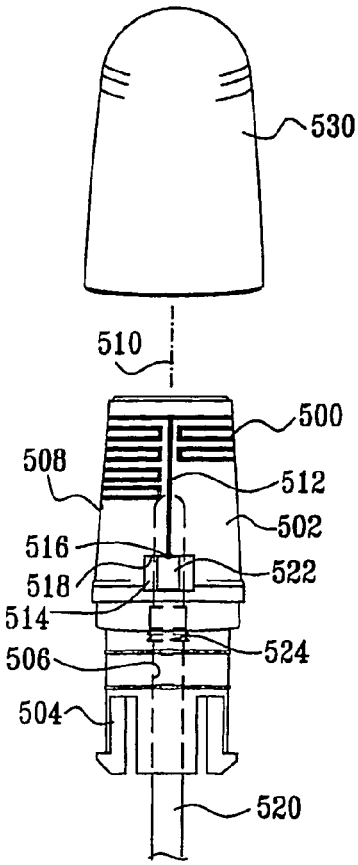
FIG. 10B is a simplified pictorial partially assembled view illustration of the antenna of FIG. 10A.
Figure 10C:
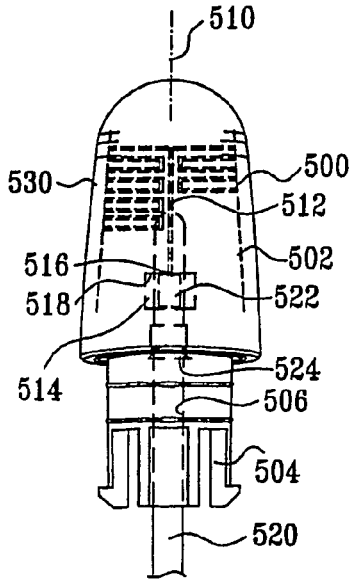
FIG. 10C is a simplified pictorial fully assembled view illustration of the antenna of FIGS. 10A & 10B.

Reference is now made to FIGS. 10A, 10B and 10C, which illustrate an external snap-in antenna including a three-dimensional meander radiating element 500, constructed in accordance with a preferred embodiment of the present invention.

As seen particularly clearly in FIG. 10A, in accordance with a preferred embodiment of the present invention, the meander radiating element 500 is formed by applying a wet conductive material, preferably a conductive polymer, onto a stubby base element 502, typically injection molded of plastic and having attachment prongs 504 and an internal axial bore 506. Application of the wet conductive material may be carried out in accordance with any of the methodologies described hereinabove.

Stubby base element 502 defines a truncated generally conical shaped antenna support surface 508 having a generally elliptical cross section and arranged about a longitudinal axis 510. The meander radiating element 500 preferably lies about a majority of the circumference of antenna support surface 508 and includes an elongate feed portion 512 which extends to an opening 514, formed in surface 508 and communicating with internal axial bore 506, and terminates in a conductor portion 516 disposed on an edge 518 of opening 514.

A conductive antenna feed shaft 520 is seated within internal axial bore 506 such that a conductive contact surface 522 thereof is in ohmic contact with conductor portion 516, thereby establishing electrical contact between feed shaft 520 and meander radiating element 500. A plurality of circumferential ribs 524 frictionally retain the conductive antenna feed shaft 520 in conductive engagement with conductor portion 516 within bore 506. A dielectric cover 530 is preferably snap-fit or press-fit over base element 502 and meander radiating element 500 printed thereon.

Figure 11:
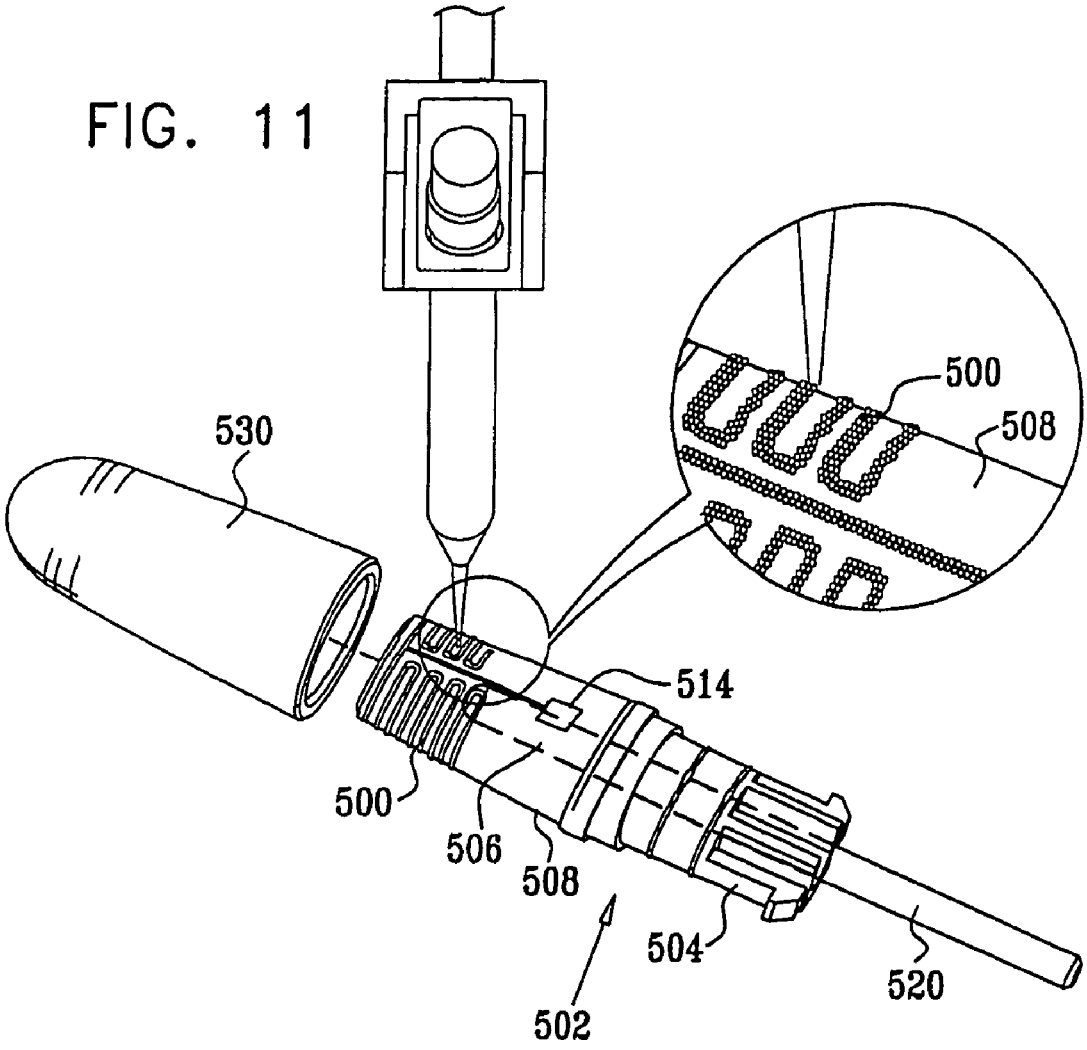
FIG. 11 is a simplified illustration of methodology for producing the antenna of FIGS. 10A-10C.

FIG. 11 illustrates in a simplified manner a methodology for producing the antenna of FIGS. 10A-10C, preferably employing application of sub-micron conductive particles to the antenna support surface 508 to define the meander element 500 thereon. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference. Alternatively, any other suitable technique for applying a wet conductive material to surface 508 may be employed for defining the meander element.

Figure 12A:
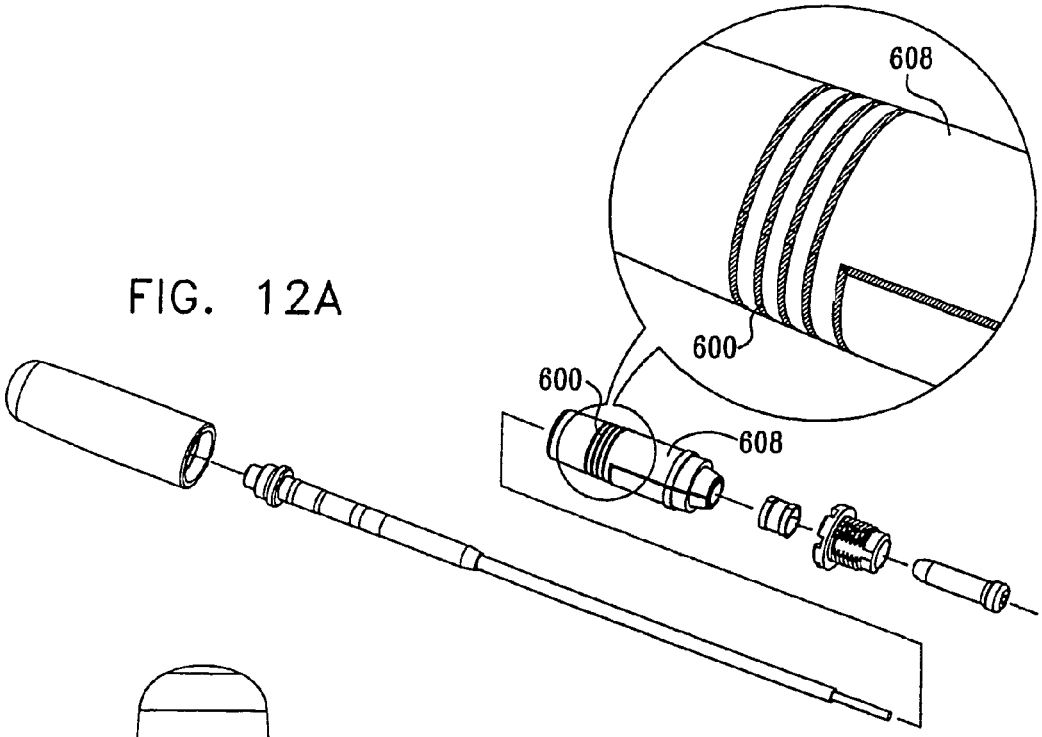
FIG. 12A is a simplified pictorial exploded view illustration of an external retractable top helical antenna having a three-dimensional coil or meander element, constructed in accordance with a preferred embodiment of the present invention.
Figure 12B:
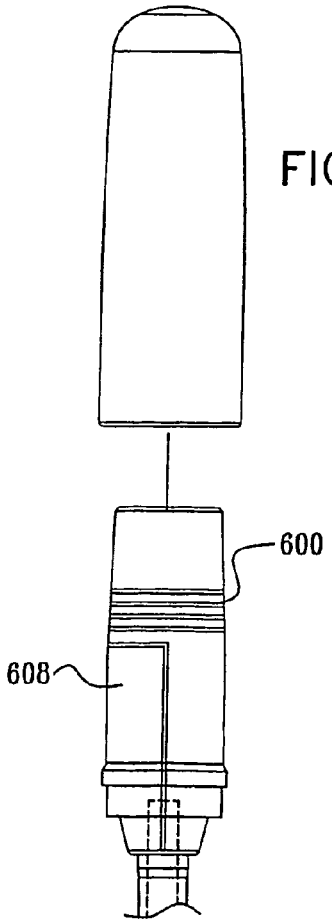
FIG. 12B is a simplified pictorial partially assembled view illustration of the antenna of FIG. 12A.
Figure 12C:
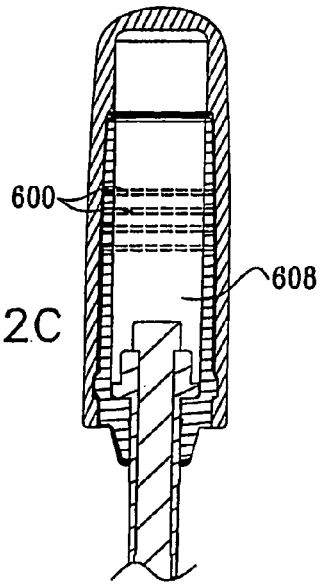
FIG. 12C is a simplified pictorial fully assembled view illustration of the antenna of FIGS. 12A & 12B.

Reference is now made to FIGS. 12A, 12B and 12C, which illustrate an external retractable top helical antenna constructed and operative in accordance with a preferred embodiment of the present invention and having a three-dimensional coil or meander element 600, preferably formed by application of sub-micron conductive particles to an antenna support surface 608. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference. Alternatively, any other suitable technique for applying a wet conductive material to surface 608 may be employed for defining the coil or meander element.

Figure 13:
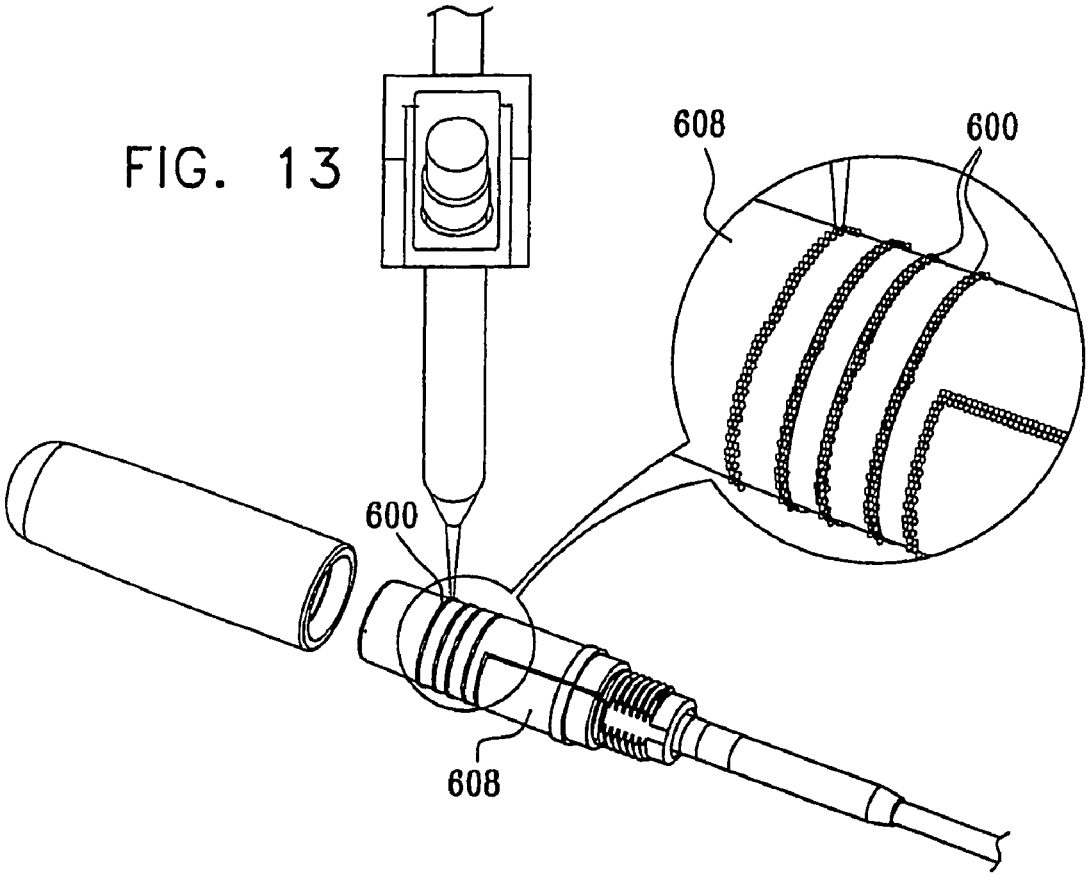
FIG. 13 is a simplified illustration of a methodology for producing the antenna of FIGS. 12A-12C.

FIG. 13 illustrates in a simplified manner a methodology for producing the antenna of FIGS. 12A-12C, preferably employing application of sub-micron conductive particles to the antenna support surface 608 to define the meander element 600 thereon. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference. Alternatively, any other suitable technique for applying a wet conductive material to surface 608 may be employed for defining the meander element.

Figure 14A:
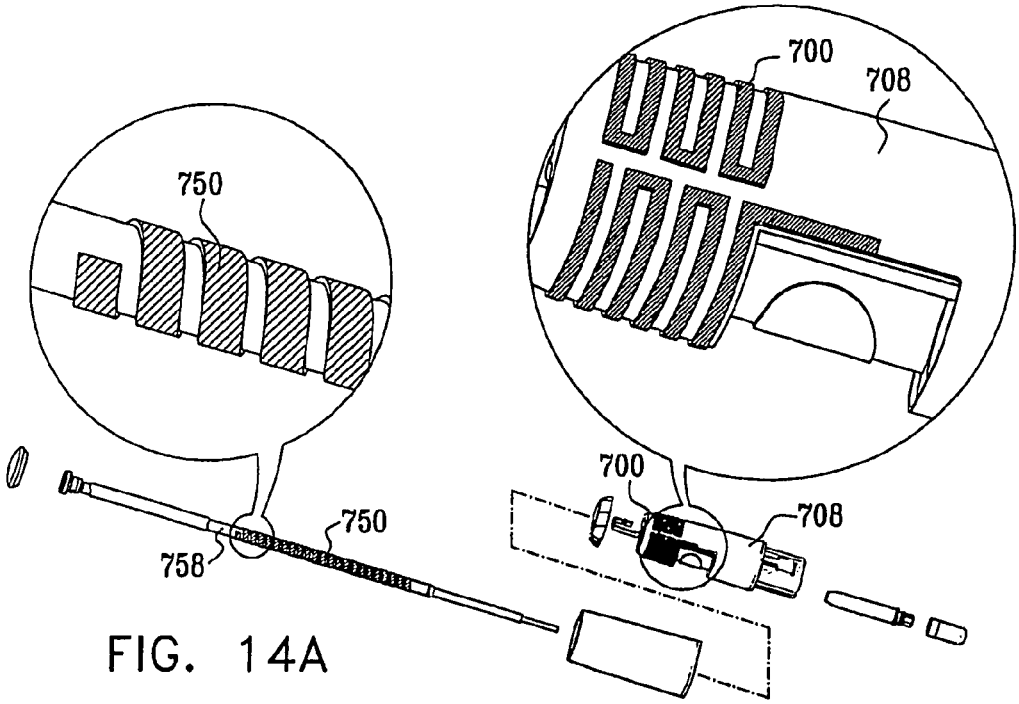
FIG. 14A is a simplified pictorial exploded view illustration of an external retractable base helical antenna having two three-dimensional coil or meander elements, constructed in accordance with a preferred embodiment of the present invention.
Figure 14B:
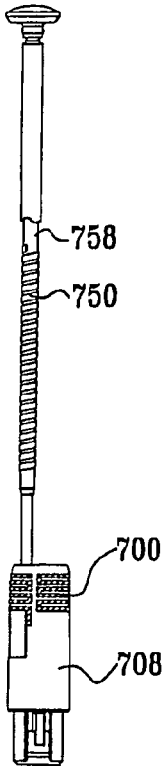
FIG. 14B is a simplified pictorial partially assembled view illustration of the antenna of FIG. 14A.
Figure 14C:
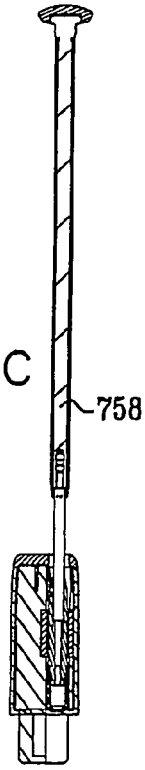
FIG. 14C is a simplified pictorial fully assembled view illustration of the antenna of FIGS. 14A & 14B.

Reference is now made to FIGS. 14A, 14B and 14C, which illustrate an external retractable base helical antenna having two three-dimensional coil or meander elements, constructed in accordance with a preferred embodiment of the present invention. The antenna of FIGS. 14A-14C includes a first three-dimensional coil or meander element 700, preferably formed by application of sub-micron conductive particles to an antenna support surface 708, and a second three-dimensional coil or meander element 750, preferably formed by application of sub-micron conductive particles to a whip antenna portion support surface 758. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference. Alternatively, any other suitable technique for applying a wet conductive material to surfaces 708 and 758 may be employed for defining the coil or meander element.

Figure 15:
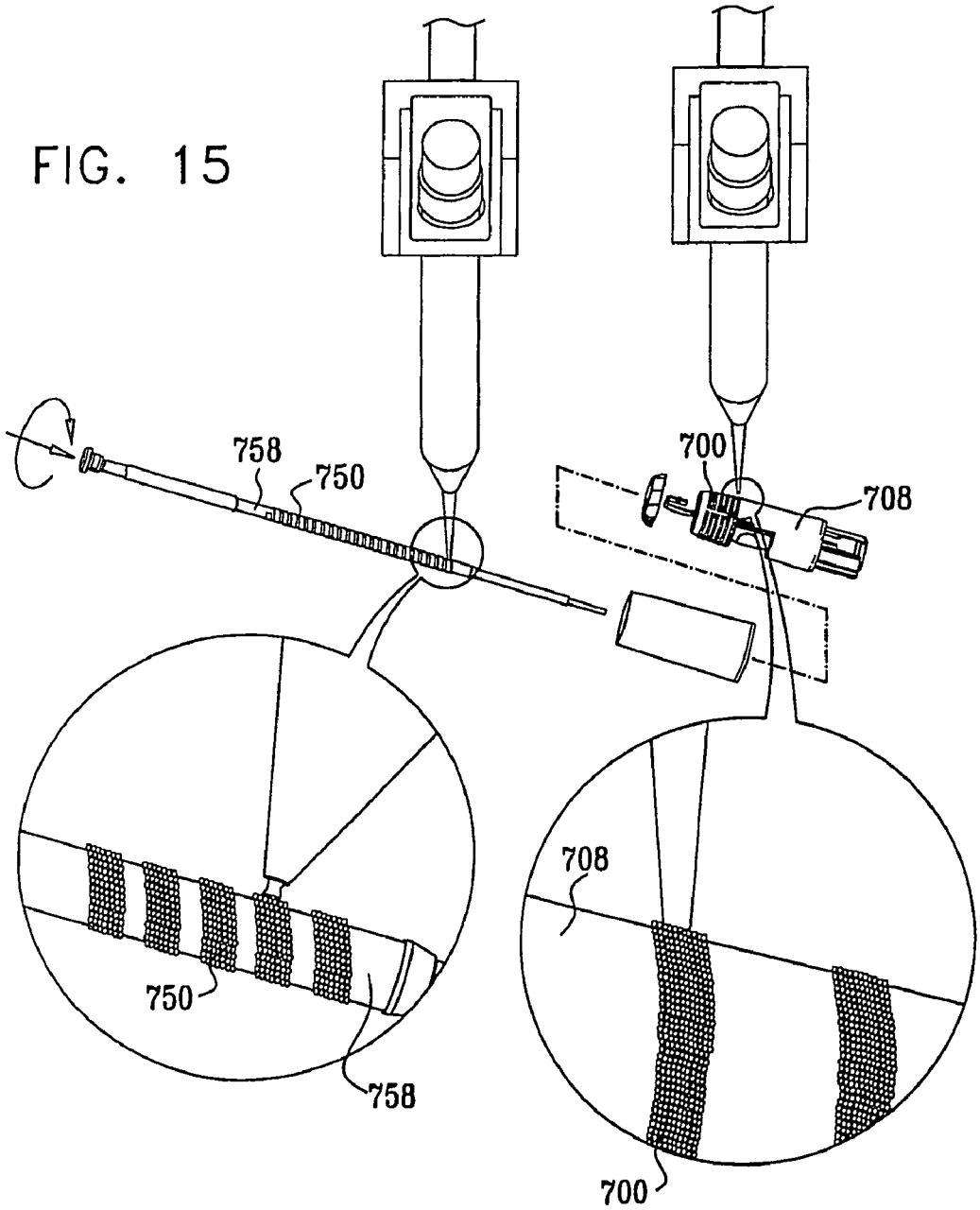
FIG. 15 is a simplified illustration of a methodology for producing the antenna of FIGS. 14A-14C.

FIG. 15 illustrates in a simplified manner a methodology for producing the antenna of FIGS. 14A-14C, preferably employing application of sub-micron conductive particles to the antenna support surfaces 708 and 758 to define the respective coil or meander elements 700 and 750 printed thereon. Application of sub-micron conductive particles is preferably effected using equipment, materials and methodologies commercially available from Optomec, Inc. of Albuquerque, N. Mex., USA and described in one or more of their U.S. Pat. Nos. 6,823,124; 6,251,488 and 6,811,744, and published U.S. Patent Applications 2004/0197493; 2004/0179808 and 2005/0046664, the disclosures of which are hereby incorporated by reference. Alternatively, any other suitable technique for applying a wet conductive material to surfaces 708 and 758 may be employed for defining the meander element.

It will be appreciated by persons skilled in the art that the present invention is not limited to what has been particularly shown and described hereinabove. Rather the scope of the present invention includes both combinations and subcombinations of various features described hereinabove as well as modifications thereof which would occur to persons skilled in the art upon reading the foregoing specification and which are not in the prior art.

The invention claimed is:

1. An antenna comprising a three-dimensional conductive layer being applied to at least one support surface having at least a first generally two-dimensional surface portion and at least a second generally three-dimensional surface portion, said three-dimensional conductive layer comprising:

a conductive coating applied to said at least a first generally two-dimensional surface portion; and conductive particles applied to said at least a second generally three-dimensional surface portion in a predetermined pattern extending at least generally along the periphery of said three-dimensional conductive layer.

2. An antenna according to claim 1 and wherein said conductive coating is a polymer.

3. An antenna according to claim 2 and wherein said polymer comprises at least one of silver and nanoparticles.

4. A mobile communicator comprising:

a housing portion;

a carrier element, at least one of said housing portion and said carrier element defining at least one support surface having at least a first generally two-dimensional surface portion and at least a second generally three-dimensional surface portion; and an antenna, said antenna defined by a three-dimensional conductive layer being applied to said at least one support surface, said three-dimensional conductive layer comprising: a conductive coating applied to said at least a first generally two-dimensional surface portion; and conductive particles applied to said at least a second generally three-dimensional surface portion in a predetermined pattern extending at least generally along the periphery of said precision three-dimensional conductive layer.

5. A mobile communicator according to claim 4 and wherein said antenna is embedded in said housing portion.

6. A mobile communicator according to claim 4 and wherein said conductive coating is a polymer.

7. A mobile communicator according to claim 6 and wherein said polymer comprises at least one of silver and nanoparticles.

8. A precision three-dimensional conductive layer, said conductive layer being applied to at least one support surface having at least a first generally two-dimensional surface portion and at least a second generally three-dimensional surface portion, said conductive layer comprising:

a conductive coating applied to said at least a first generally two-dimensional surface portion; and conductive particles applied to said at least a second generally three-dimensional surface portion in a predetermined pattern extending at least generally along the periphery of said precision three-dimensional conductive layer.

9. A precision three-dimensional conductive layer according to claim 8 and wherein said conductive coating is a polymer.

10. A precision three-dimensional conductive layer according to claim 9 and wherein said polymer comprises at least one of silver and nanoparticles.

* * * * *